US008561268B2

(12) United States Patent
Hortnagl

(10) Patent No.: US 8,561,268 B2
(45) Date of Patent: Oct. 22, 2013

(54) BELT BUCKLE AND METHOD FOR PRODUCING A BELT BUCKLE

(75) Inventor: Andreas Hortnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 642 days.

(21) Appl. No.: 12/551,679

(22) Filed: Sep. 1, 2009

(65) Prior Publication Data

US 2010/0071173 A1 Mar. 25, 2010

(30) Foreign Application Priority Data

Sep. 19, 2008 (AT) ..... A1466/2008

(51) Int. Cl.
*A44B 11/25* (2006.01)

(52) U.S. Cl.
USPC ..... 24/648; 24/634; 24/625

(58) Field of Classification Search
USPC ..... 24/614, 615, 625, 629, 648
See application file for complete search history.

(56) References Cited

U.S. PATENT DOCUMENTS

| | | | | |
|---|---|---|---|---|
| 3,591,900 A | | 7/1971 | Brown | |
| D241,089 S | | 8/1976 | Stafstrom | |
| 4,321,734 A | * | 3/1982 | Gandelman | 24/648 |
| 4,473,926 A | | 10/1984 | Ono | |
| 4,672,725 A | * | 6/1987 | Kasai | 24/625 |
| 4,987,661 A | * | 1/1991 | Kasai | 24/625 |
| 5,291,641 A | * | 3/1994 | Morino | 24/625 |
| D360,390 S | | 7/1995 | Murai | |
| 5,472,234 A | | 12/1995 | Chang | |
| 6,965,231 B1 | * | 11/2005 | Cinoglu et al. | 324/300 |
| 7,350,277 B1 | | 4/2008 | Canfield et al. | |
| 2002/0184742 A1 | | 12/2002 | Casebolt et al. | |
| 2006/0048350 A1 | | 3/2006 | Coulombe et al. | |

FOREIGN PATENT DOCUMENTS

| | | |
|---|---|---|
| AT | 30813 | 6/1998 |
| AT | 30814 | 6/1998 |
| AT | 30815 | 6/1998 |
| AT | 31486 | 8/1998 |
| AT | 31487 | 8/1998 |
| AT | 31488 | 8/1998 |
| AT | 413786 | 6/2006 |
| AU | 30813 | 6/1998 |
| AU | 30814 | 6/1998 |

(Continued)

OTHER PUBLICATIONS

MontK Berlin, Dreistegschnalle National Molding, Feb. 14, 2007, Katalog aufgenommen.

(Continued)

*Primary Examiner* — Robert J Sandy
(74) *Attorney, Agent, or Firm* — Volpe and Koenig, P.C.

(57) ABSTRACT

A belt buckle having an insertion part having at least a belt opening for guiding a belt and an insertion appendage extending in a direction of insertion with holding catches at both sides projecting in the perpendicular direction, and a receiving part having a basic body with at least a belt opening for guiding a belt and with an insertion opening, beginning at an inserting side of the basic body for inserting the insertion appendage of the insertion part in the direction of insertion, and with latches pivotally mounted to the basic body, which in the locking position in the inserted state of the receiving part and the insertion part cooperate with holding catches and retain the insertion appendage in the insertion opening of the receiving part.

8 Claims, 4 Drawing Sheets

(56) References Cited

FOREIGN PATENT DOCUMENTS

| | | |
|---|---|---|
| AU | 30815 | 6/1998 |
| AU | 31486 | 8/1998 |
| AU | 31487 | 8/1998 |
| AU | 31488 | 8/1998 |
| DE | 6608511 | 9/1971 |
| DE | 2323870 | 11/1974 |
| DE | 3216075 | 11/1983 |
| DE | 3934300 | 4/1990 |
| DM | 045484 | 10/1998 |
| EM | 000565155-00001 | 7/2006 |
| EM | 000565155-0002 | 7/2006 |
| EM | 000565155-0003 | 7/2006 |
| EM | 000565155-0004 | 7/2006 |
| EM | 000565155-0005 | 7/2006 |
| EM | 000565155-0006 | 7/2006 |
| EM | 000565155-0007 | 7/2006 |
| EP | 000565155-00001 | 7/2006 |
| EP | 000565155-0002 | 7/2006 |
| EP | 000565155-0003 | 7/2006 |
| EP | 000565155-0004 | 7/2006 |
| EP | 000565155-0005 | 7/2006 |
| EP | 000565155-0006 | 7/2006 |
| EP | 000565155-0007 | 7/2006 |
| GB | 284497 | 2/1928 |
| GB | 2457703 | 8/2009 |
| WO | 2008045695 | 4/2008 |

OTHER PUBLICATIONS

Admitted prior art buckles (date unknown).

Click Buckle, Feb. 4, 2009, detected in internet: <http://www.austrialpin.com/03-austrialpin/bilder/pdtprod/cobra.pdf>, the whole document.

Bulcke Clif, FIX, Feb. 4, 2009, detected in internet: <http://www.stubai-bergsport.com-->products-->aviation>, the whole document.

Gurtschnallen Buckles, detected in internet: http://www.austrialpin.at/03-austrialpin/ger/detail/detai.php?sid=02060, the whole document (Admitted prior art) dated 1998.

Skysports, detected in internet: http:/www.austrialpin.at/03-austrialpin/eng/overview/over.php?sid=02, the whole document (Admitted prior art) dated Jan. 1, 2007.

Austrian Alpin Catalog, pp. 36 and 37, Aug. 2000.

Admitted prior art #1, Jan. 1, 2007.

Admitted prior art #2, Jan. 1, 2007.

Admitted prior art #3, Jan. 1, 2007.

Admitted prior art #4, Jan. 1, 2007.

Admitted prior art #5, Jan. 1, 2007.

Admitted prior art #6, Jan. 1, 2007.

Admitted prior art #7, Jan. 1, 2007.

Gurtschnalle CLICL Fix verstellbar, admitted prior art, Jan. 1, 2007.

Cobra Compact, Admitted prior art, Jan. 1, 2007.

* cited by examiner

Fig. 2
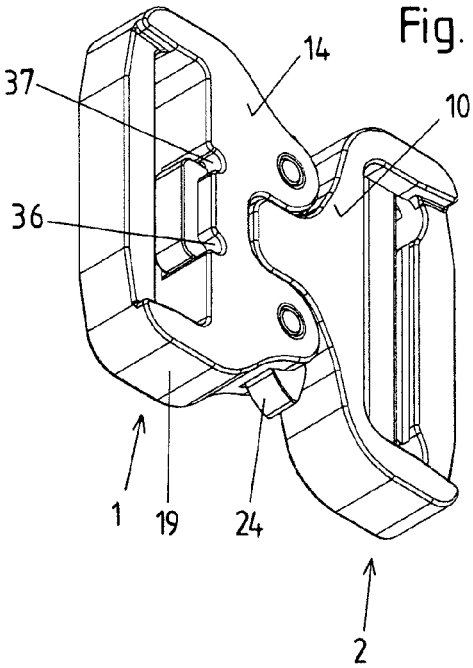
Fig. 1
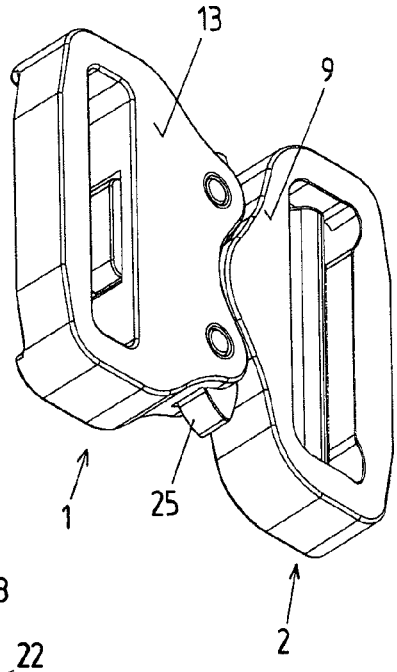
Fig. 3
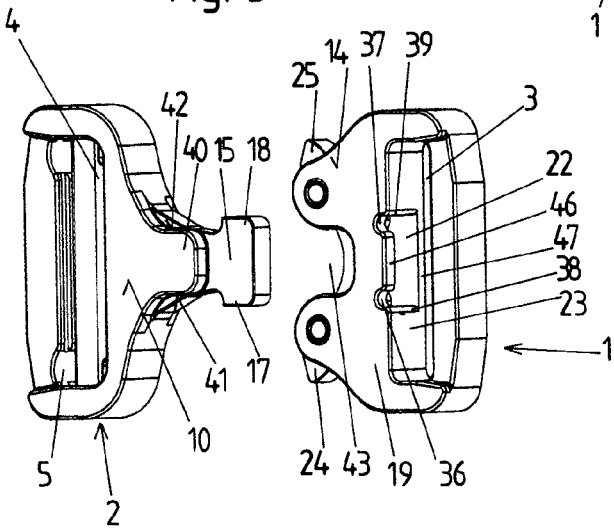
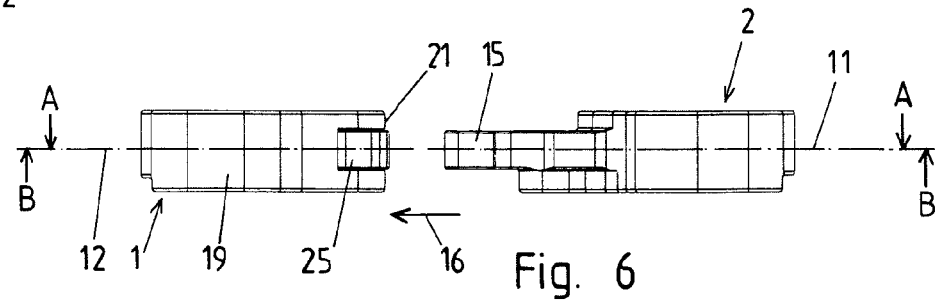
Fig. 6

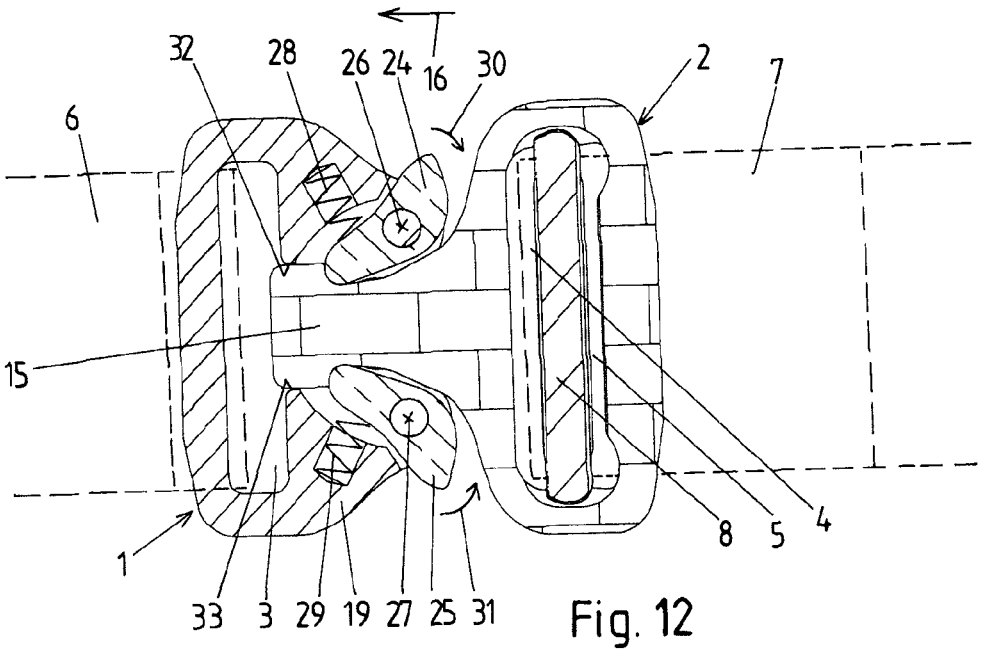
Fig. 12
Fig. 13
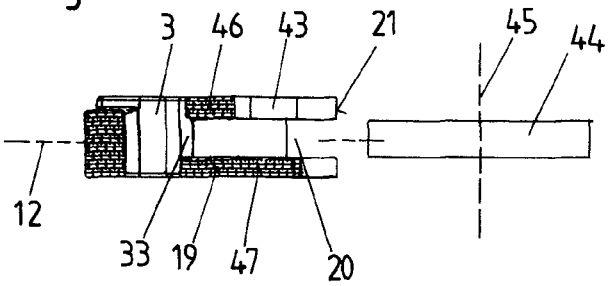
Fig. 14
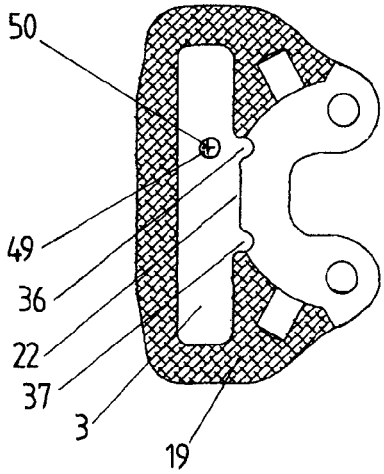

BELT BUCKLE AND METHOD FOR PRODUCING A BELT BUCKLE

CROSS-REFERENCE TO RELATED APPLICATIONS

This application claims the benefit of Austrian application No. A1466/2008, filed Sep. 19, 2008, the contents of which are incorporated herein by reference as if fully set forth.

BACKGROUND

The invention relates to a method for producing a belt buckle, which comprises an insertion part, having at least one belt opening for guiding a belt and an insertion appendage extending in the direction of insertion with holding catches protruding at both sides in the perpendicular direction, and a receiving part, comprising a basic body with at least one belt opening for guiding a belt and with a latch, extending from an insertion opening beginning at the insertion side of the basic body for inserting the insertion appendage of the insertion part in the direction of insertion and pivotally fastened at the basic body, cooperating with the holding catches in a locking position in the inserted state of the receiving part and the insertion part and ensuring the insertion appendage in the insertion opening of the receiving part, with the insertion opening being cut via a keyway cutter in the direction of insertion, beginning at the inserting side of the basic body, and forming a penetrating opening in the basic body, penetrating the basic body to the belt opening.

Furthermore, the invention relates to a belt buckle comprising an insertion part, having at least one belt opening for guiding a belt and an insertion appendage extending in the direction of insertion with holding catches protruding at both sides in the perpendicular direction, and a receiving part, comprising a basic body with at least one belt opening for guiding a belt and with an insertion opening beginning at the inserting side of the basic body for inserting the insertion appendage of the insertion part in the direction of insertion and provided with latches, mounted pivotally at the basic body, in the locking position in the inserted state of the receiving part and the insertion part cooperating with the holding catches of the insertion appendage of the insertion part and ensuring the insertion appendage in the insertion opening of the receiving part, with the insertion opening beginning at the inserting side of the basic body and being embodied as a penetrating opening penetrating the basic body to the belt opening.

A belt buckle produced according to such a method, for example for safety belts for fall protection, is known from the international trademark DM/045484 previously used by the applicant. Although this belt buckle has been proven in practice, higher load capacities of the buckle are desirable for certain applications.

In another buckle, even older and also known from prior use, the insertion opening in the basic body of the receiving part is not embodied as a penetrating opening extending to the belt opening but in the form of a blind hole. Here, a problem develops by dirt collecting in the insertion opening over time. For the purpose of lateral guidance, a slot-shaped recess is provided in the insertion appendage in its frontal section extending in the direction of insertion, cooperating with a bolt extending between the frontal and the rear lateral wall, limiting the insertion opening of the basic body of the receiving part. The slot-shaped recess additionally weakens the end of the insertion appendage.

SUMMARY

The invention is intended to achieve increased stability against a load applied via belts, to be mounted at the belt buckle, in reference to the belt buckle using a method of the type mentioned at the outset and/or a belt buckle of the type mentioned at the outset.

This is attained according to the invention in a method for producing a belt buckle, comprising: an insertion part having at least one belt opening for guiding a belt and an insertion appendage extending in the direction of insertion with holding catches protruding at both sides in the perpendicular direction, and a receiving part comprising a basic body with at least one belt opening for guiding a belt. An insertion opening begins at the inserting side of the basic body for inserting the insertion appendage of the insertion part in the direction of insertion and latches mounted pivotally at the basic body, in the locking position in the inserted state of the receiving part and the insertion part cooperating with the holding catches and ensuring the insertion appendage in the insertion opening of the receiving part. The method, in which a penetrating opening is formed penetrating the basic body to the belt opening, comprises the steps of: cutting the basic body via a keyway cutter beginning at the inserting side of the basic body in the direction of insertion, forming the insertion opening, and in another cutting step cutting the basic body beginning at the belt opening, with at least a first and a second recess, beginning at the belt opening, as well as guiding surfaces are formed for the two edge surfaces of the holding catches of the insertion appendage of the insertion part pointing in the perpendicular direction, with the guiding surfaces limiting the penetrating opening at both sides in the perpendicular direction in the area that the penetrating opening opens into the belt opening.

A belt buckle according to the invention comprises an insertion part having at least one belt opening for guiding a belt and an insertion appendage extending in the direction of insertion with holding catches protruding at both sides in a perpendicular direction, and a receiving part comprising a basic body with at least one belt opening for guiding a belt and with an insertion opening, beginning at the inserting side of the basic body, for inserting the insertion appendage of the insertion part in the direction of insertion, and latches pivotally mounted at the basic body, which in the locking position in the inserted state of the receiving part and the insertion part cooperate with the holding catches of the insertion appendage of the insertion part and retain the insertion appendage in the insertion opening of the receiving part, with the insertion opening beginning at the inserting side of the basic body and being embodied as a penetrating opening penetrating the basic body to the belt opening, and guiding surfaces for the two edge surfaces of the holding catches of the insertion appendage of the insertion part pointing in the perpendicular direction being provided, which limit the penetrating opening of the basic body at both sides in the perpendicular direction in the area that it opens into the belt opening.

In the method according to the invention, the basic body of the receiving part is cut beginning at the belt opening. Here, first and second recesses are formed in the limiting surface limiting the belt opening at the side facing the insertion part. Further, hereby first and second guiding surfaces are formed, limiting the penetrating opening at both sides in the area that it opens into the belt opening and cooperating with the edge surfaces of the holding catches of the insertion part pointing in the perpendicular direction and away from each other. The perpendicular direction is aligned at a right angle in reference to the direction of insertion and parallel in reference to a primary plane of the receiving part.

At the basic body, the belt buckle according to the invention is provided with guiding surfaces for the edge surfaces of the holding catches of the insertion appendage of the insertion part, pointing in the perpendicular direction. They limit the penetrating opening of the basic body at both sides in reference to the perpendicular direction in the area that it opens into the belt opening.

With the invention, the stability of the belt buckle is increased in the inserted state of the insertion part and the receiving part. By the cooperation of the guiding surfaces of the basic body of the receiving part with the edge surfaces of the holding catches of the insertion appendage of the insertion part, in case of high tensile forces acting upon the belts mounted to the parts of the belt buckle, any tilting of the insertion part in reference to the receiving part (around an axis aligned at a right angle in reference to the direction of insertion and at a right angle in reference to the perpendicular direction) is counteracted. Such a tilting can lead to an asymmetrical load distribution causing a considerably higher load to one of the latches and the holding catches cooperating therewith than to the other latch and the holding catch cooperating with it.

The guiding surfaces of the basic body of the insertion part are preferably located in planes with their normal surfaces being positioned essentially parallel in reference to the perpendicular direction. Here, the statement "essentially parallel" shall include deviations in reference to the parallel by +/−5°.

The lengths of the guiding surfaces measured in the direction of insertion preferably amount to at least 0.5 mm, with a particularly preferred length of at least 1 mm.

In a preferred exemplary embodiment of the invention, further a stop is formed at the insertion appendage protruding in a direction at a right angle in reference to the direction of insertion and at a right angle in reference to the perpendicular direction, comprising edge surfaces pointing in the perpendicular direction which cooperate with edge surfaces of a guiding recess in the basic body of the insertion part. The guiding recess begins at the inserting side of the basic body. The edge surfaces of the stop of the insertion appendage and the edge surfaces of the guiding recesses cooperating therewith are here preferably located in planes essentially parallel in reference to the perpendicular direction. Here, the term "essentially perpendicular" shall include deviations from the parallel by up to +/−10°.

BRIEF DESCRIPTION OF THE DRAWINGS

In the following, additional advantages and details of the invention are explained in greater detail using the attached drawing.

In the drawings:

FIGS. 1 and 2 are perspective views of the belt buckle in the inserted state of the receiving part and the insertion part from various angles (one time the frontal lateral surface is visible and one time the rear one);

FIG. 3 is another perspective view from a different angle of view (with the rear lateral surfaces being visible);

FIGS. 4, 5, and 6 are side views of the frontal and the rear lateral surfaces and the edge surfaces in the separated state of the insertion part and the receiving part;

FIG. 12 is a cross-section along the line CC of FIG. 11;

FIG. 13 is a schematic illustration of the basic body of the receiving part together with a keyway cutter, in a cross-section along the line DD of FIG. 5;

FIG. 14 is a schematic cross-section of the basic body of the receiving part together with a cylindrical cutter along a line AA of FIG. 6;

Figure 5:
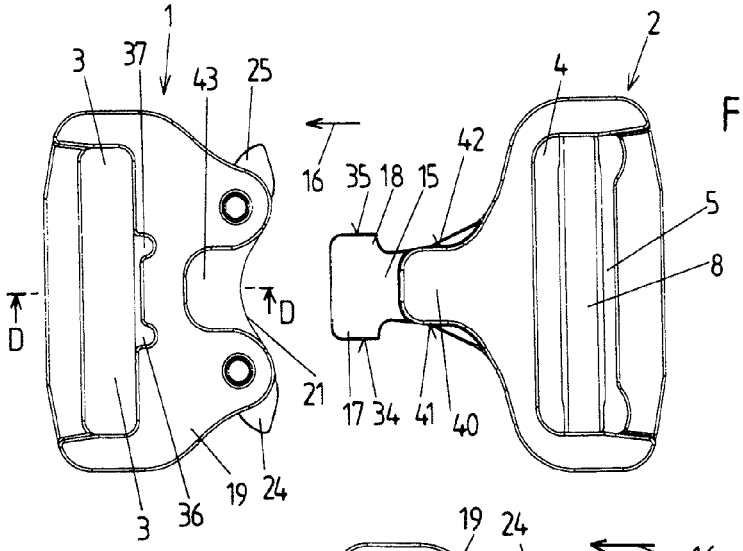
Figure 4:
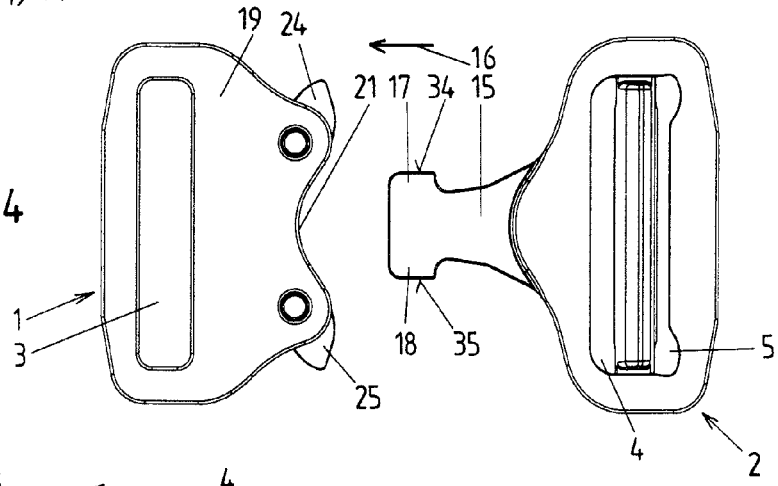

The figures are shown in different scales.

DETAILED DESCRIPTION OF THE PREFERRED EMBODIMENTS

The belt buckle according to the invention comprises a receiving part 1 (=female buckle part) and an insertion part 2 (=male buckle part) interlocking with each other in the inserted state. The receiving part 1 and the insertion part 2 are each provided with at least one belt opening 3, 4, 5 for guiding a belt 6, 7 to be connected with the receiving part 1 and/or the insertion part 2. The belts 6, 7 are only indicated by dot-dash lines in FIGS. 7 and 12. In the exemplary embodiment shown, the receiving part 1 has only one belt opening 3 to connect a belt 6 in a fixed manner to the receiving part 1 (by guiding it through the belt opening 3 and sewing it), while the insertion part 2 has two belt openings 4, 5, located at both sides of a displaceable central bar 8, in order to connect a belt 7 to the insertion part 2 in an adjustable fashion. Here, the end of the belt is pulled in a manner known per se from the rear lateral surface 10 of the insertion part 2 through the belt opening 4, over the central bar 8, and further through the belt opening 5.

In contrast to the illustrations shown, both the receiving part 1 as well as the insertion part 2 may be provided with one belt opening only for a fixed mounting of an end of the belt, or both the insertion part as well as the receiving part may include several belt openings for an adjustable connection to a belt. The inverse arrangements is also possible, with one end of the belt being connected to the receiving part 1 in an adjustable fashion and one end of the belt to the insertion part 2 in a fixed manner.

The belts 6, 7 connected to the receiving part 1 and the insertion part 2 may also represent separate belts or the two ends of a single belt.

The insertion part 2 has a primary plane 11. The frontal and the rear lateral surfaces 9, 10 are located parallel in reference to the primary plane 11 and/or have sections positioned parallel in reference to the primary plane 11. The receiving part 1 has a primary plane 12. The frontal and the rear lateral surface 13, 14 of the receiving part 1 are located parallel in reference to the primary plane 12 and/or have sections positioned parallel in reference to the primary plane 12.

In the inserted state of the receiving part 1 and the insertion part 2, the primary planes 11, 12 of the insertion part 2 and the receiving part 1 are positioned in and/or define a common plane.

The axes of the belt openings 3, 4, 5 are positioned at a right angle in reference to the primary planes 12, 11.

In the operational state, connected to the belts 6, 7, the rear lateral surface 10 of the insertion part 2 and the rear lateral surface 14 of the receiving part 1 point in the direction of the user carrying the belts 6, 7 and/or the object the belts 6, 7 contact.

Preferably the receiving part and the insertion part are made from metal, particularly aluminum. An embodiment made e.g. from titanium via lost-wax casting can also be made or is possible.

Beginning at one of the sections of the insertion part 2 forming the belt openings 4, 5, an insertion appendage 15 of the insertion part 2 extends, in a direction of insertion 16. In the area of a free end, frontal in reference to the direction of insertion 16, the insertion appendage 15 has holding catches 17, 18, which are arranged at both sides at the insertion appendage 15. The holding catches 17, 18 each project in a perpendicular direction aligned at a right angle in reference to the direction of insertion 16 and parallel in reference to the primary plane 11. The perpendicular direction is the direction, in which the belt openings 3, 4, 5 determine the maximum width of the belt.

The receiving part 1 has a basic body 19, in which the belt opening 3 is embodied. The basic body 19 is further provided with an insertion opening 20, in which the insertion appendage 15 of the insertion part 2 is inserted in the direction of insertion 16, when the two parts 1, 2 of the buckle are connected to each other. The insertion opening 20 begins at the inserting side 21 of the receiving part 1, which is the narrow side of the receiving part 1 facing the insertion part 2 to be inserted. The insertion opening 20 is embodied as a penetrating opening penetrating the basic body 19 to the belt opening 3, i.e. it opens on the one hand at the inserting side 21 of the basic body 19 and on the other side into the belt opening 3, with a window 22 being formed in the limiting surface 23 of the belt opening 3 (cf. particularly FIG. 3). Measured in the perpendicular direction the width of this window 22 is narrower, i.e. less than half the size than the width of the belt opening 3 measured in the perpendicular direction. In other words, the basic body 19 of the receiving part 1 has a channel, which on the one side opens at the inserting side 21 and forms the insertion opening 20 and on the other side opens in the belt opening 3 and here forms a window 22, which is embodied in the limiting surface 23 of the belt opening 3, limiting the belt opening 3 at the side facing the inserting side 21.

First and second latches 24, 25 are pivotally mounted to the basic body 19 of the receiving part 1. The pivoting axes 26, 27 are aligned at a right angle in reference to the direction of insertion 16 and at a right angle in reference to the perpendicular direction, thus they are positioned at a right angle in reference to the primary plane 12. In the state of the parts 1, 2 of the buckle inserted into each other and interlocked, the latches 24, 25 are in a locking position, in which they cooperate with the holding catches 17, 18. By engaging the holding catches 17, 18 they block the insertion appendages 15 from being pulled out of the insertion opening 20 against the direction of insertion 16. The latches 24, 25 are impinged in the locking position by spring elements 28, 29, in the exemplary embodiment shown they represent coil springs projecting from blind bores of the basic body 19 into the penetrating opening of the basic body 19 and also supported on the one side at the bottom of the blind bore and on the other side at the latch. The latches 24, 25 are two-armed levers. By the lever arm projecting from the basic body 19 being engaged (the forces to be applied are symbolized by the arrows 30, 31 in FIG. 12) the latches 24, 25 are pivoted around their axes into the opening position, in which they release the holding catches 17, 18, allowing the insertion appendage 15 to be pulled out of the insertion opening 20.

In order to connect the separated parts 1, 2 of the buckle the insertion part 2 is inserted into the insertion opening 20, with the front end of the insertion appendage 15 in reference to the direction of insertion 16 approaches the lever arms of the latches 24, 25 located inside the basic body 19 and forcefully separates them by pivoting the latches 24, 25 around their pivotal axes 26, 27 against the force of the spring elements 28, 29 until the latches 24, 25 engage behind the fastening catches 17, 18 in the entirely inserted state of the insertion part 2.

In the area of the entrance of the penetrating opening of the basic body 19 and/or the channel through the basic body 19 in the belt opening 3, i.e. in the area adjacent to the window 22, the penetrating opening of the basic body 19 and/or the channel through the basic body 19 is limited in the perpendicular direction at both sides by guiding surfaces 32, 33. These guiding surfaces 32, 33 serve to guide the edge surfaces 34, 35 of the holding catches 17, 18 pointing in the perpendicular direction. The guiding surfaces 32, 33 therefore counteract a displacement of the edge surfaces 34, 35 in the perpendicular direction, with it representing a planar support for the edge surfaces 34, 35 and not simply representing edges.

The guiding surfaces 32, 33 and the sections of the edge surfaces 34, 35 cooperating with them are preferably located in planes with their normal surface being positioned essentially parallel to the perpendicular direction.

For a simple embodiment of the penetrating opening through the basic body 19 with the guiding surfaces 32, 33, which is explained in greater detail in the following, the limiting surface 23 of the belt opening 3, in which the window 22 is embodied, is provided with first and second recesses 36, 37. The recesses 36, 37 begin at the window 22, namely they penetrate one of the two walls 46, 47 (cf. FIGS. 3 and 13), which are located between the penetrating opening through the basic body 19 of the receiving part 1 and the lateral surface 13, 14 of the receiving part 1 and with their faces forming sections of the limiting surface 23 of the belt opening 3, with both of them penetrating the same wall 46 and are distanced in reference to the perpendicular direction. In reference to the perpendicular direction, a respective recess 36, 37 follows adjacent to the respective two lateral edges 38, 39 limiting the window 22 in the perpendicular direction and extend, beginning at the respective lateral edge 38, 39, in the direction to the other lateral edge 38, 39.

Figure 7:
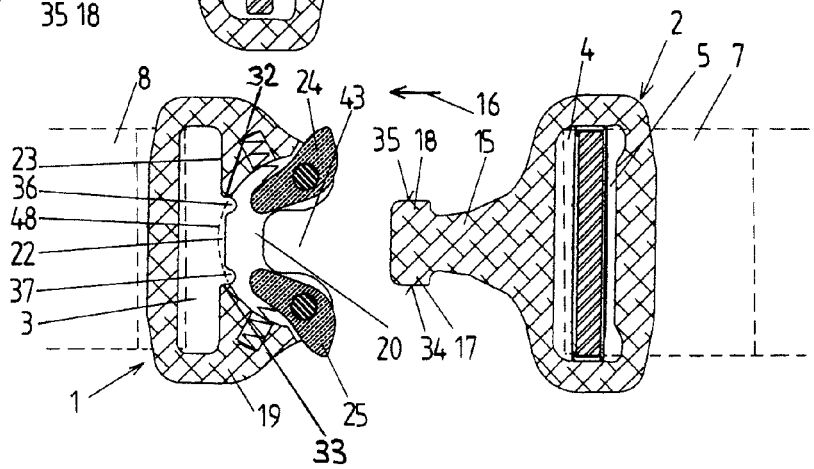
Figure 10:
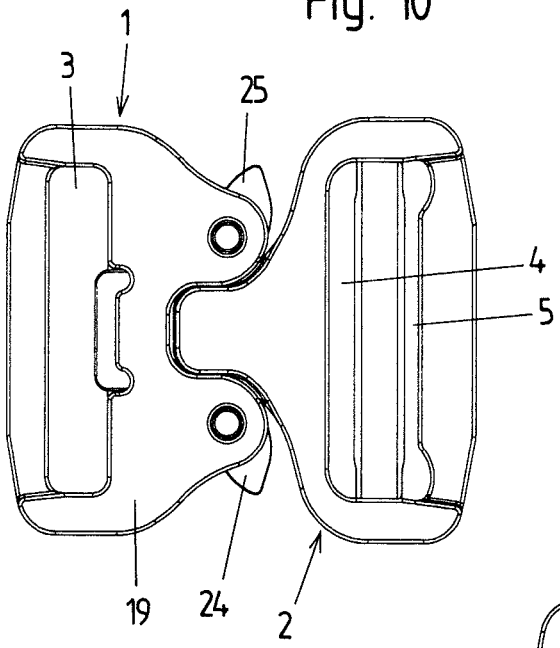
FIGS. 9 through 11 are views according to FIGS. 4 through 6 in the inserted state of the insertion part and the receiving part.
Figure 9:
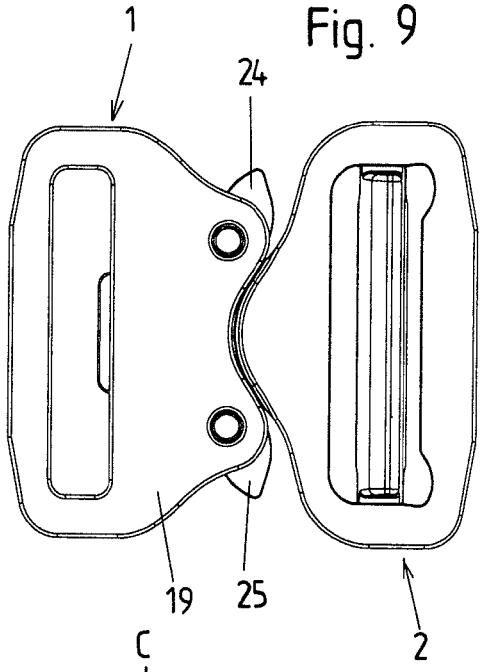
Figure 11:
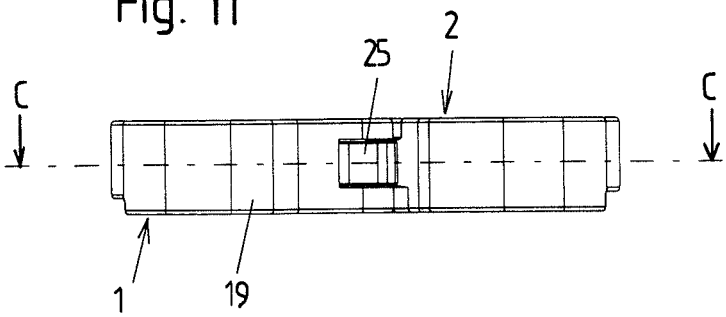

The lateral wall 46 can be slightly spaced apart from the face pointing to the window 22 between the first and the second recess 36, 37, as discernible from FIGS. 7 and 14, for example.

It can also be imagined and is possible, although less preferred due to the additional weakening, that third and fourth recesses are embodied in the other wall 47 in a similar fashion as in the first and second recesses 36, 37.

A stop 40 is formed at the insertion appendage 15, provided with edge surfaces 41, 42, which are positioned at a right angle in reference to the primary plane 12 and point in the perpendicular direction. The edge surfaces 41, 42 of the stop 40 cooperate with the edges of a guiding recess 43 beginning at the inserting side 21 of the basic body 19 of the receiving part 1, with a guidance being formed for the insertion appendage 15. This guidance counteracts any displacement of the insertion appendage 15 in the perpendicular direction in the area of this guidance. Preferably the edge surfaces 41, 42 are positioned in planes with their normal surfaces essentially being positioned parallel in reference to the perpendicular direction.

The guidance of the insertion appendage 15, on the one hand, through the guidance surface 32, 33 and, on the other hand, through the edge surfaces 41, 42, achieves an advantageous guidance of the insertion appendage 15, with these two guides being spaced apart in the direction of insertion 16, resulting in little play of the insertion part 2 in reference to the receiving part 1 with regard to a tilting around an axis positioned at a right angle in reference to the primary plane 11, 12 in an inserted state of the two parts 1, 2 of the buckle.

Advantageously, the insertion appendage 15 of the insertion part 2 protrudes slightly from the window 22 in the inserted state of the two parts 1, 2 of the buckle, preferably at least 1 mm. Thus the guiding surfaces 32, 33 can be maximally utilized in spite of rounded edges in the area of the front end of the insertion appendage 15 in reference to the direction of insertion 16 and in spite of the existing play of the insertion part 2 in reference to the receiving part 1 in the inserted state.

Figure 8:
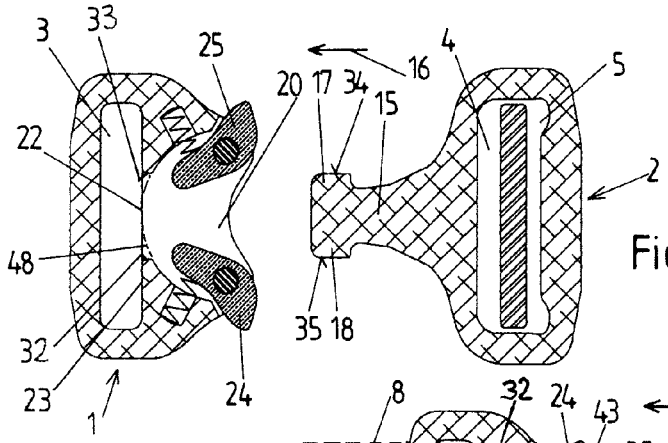
FIGS. 7 and 8 are cross-sections along the lines AA and BB of FIG. 6.

In order to produce penetrating openings through the basic body 19 forming the insertion opening 20 and the window 22, first a recess is cut with a keyway cutter beginning at the inserting side 21. The keyway cutter 44 is schematically shown in FIG. 13. It represents a tool rotating around an axis 45, positioned at a right angle in reference to the primary plane 12. The keyway cutter 44 is moved in the direction of insertion 16 against the insertion side 21 of the basic body 19, in order to cut a recess, which is limited by a circular line shown in FIGS. 7 and 8 as a dot-dash line 48.

In the following the basic body 19, beginning at the belt opening 3, is cut via a cylindrical cutter 49, which rotates around an axis 50 positioned at a right angle in reference to the primary plane 12 and shown schematically in FIG. 14. Here, the recesses 36, 37 are formed. In the area between the recesses 36, 37 the wall 46 (cf. FIG. 3) positioned between the lateral surface 14 and the penetrating opening is also slightly cut at the edge adjacent to the belt opening 3. Here, the axis of the cylindrical cutter is aligned at a right angle in reference to the primary plane 12 and the cutter is guided through the basic body 19 to the wall 47 positioned between the lateral surface 13 and the penetrating opening. Here, the wall 47 is preferably not diminished in order not to weaken said wall. The weakening of the wall 46 by cutting can be achieved by an enlarged wall thickness of the wall 46 in reference to the wall 47. When cutting the wall 46, the window 22 is also widened or created for a first time. Additionally the guiding surfaces 32, 33 are formed.

A belt buckle according to the invention can be embodied with particularly high resilience. For example, loads of at least 17.8 KN of straight tensile stress can be achieved (according to a respective norm), when the receiving part 1 and the insertion part 2 is made from basic bodies comprising aluminum, as preferred. Conventional buckles with basic bodies made from aluminum fail to reach such high strength.

A belt buckle according to the invention can be used, for example, for safety belts for fall protection or for safety belts for aviation sport, particularly for hang-gliding and paragliding.

LEGEND FOR THE REFERENCE CHARACTERS

1 Receiving part
2 Insertion part
3 Belt opening
4 Belt opening
5 Belt opening
6 Belt opening
7 Bell
8 Central bar
9 Front lateral surface
10 Rear lateral surface
11 Primary plane
12 Primary plane
13 Front lateral surface
14 Rear lateral surface
15 Insertion appendage
16 Direction of insertion
17 Holding catch
18 Holding catch
19 Basic body
20 Insertion opening
21 Inserting side
22 Window
23 Limiting surface
24 Latch
25 Latch
26 Pivoting axis
27 Pivoting axis
28 Spring element
29 Spring element
30 Arrow
31 Arrow
32 Guiding surface
33 Guiding surface
34 Edge surface
35 Edge surface
36 Recess
37 Recess
38 Lateral edge
39 Lateral edge
40 Stop
41 Edge surface
42 Edge surface
43 Guiding recesses
44 Keyway cutter
45 Axis
46 Wall
47 Wall
48 Line
49 Cutter
50 Axis

The invention claimed is:

1. A belt buckle comprising:

a. an insertion part having at least one belt opening for guiding a belt and an insertion appendage extending in a direction of insertion with holding catches protruding at both sides in a perpendicular direction, b. a receiving part with a basic body and at least a belt opening for guiding a belt and with an insertion opening, beginning at an inserting side of the basic body for inserting the insertion appendage of the insertion part in the direction of insertion, c. latches pivotally mounted to the basic body, which in a locking position in an inserted state of the receiving part and the insertion part cooperate with the holding catches of the insertion appendage of the insertion part and retain the insertion appendage in the insertion opening of the receiving part, d. the insertion opening beginning at the inserting side of the basic body and forming a penetrating opening penetrating the basic body to the belt opening, and e. guiding surfaces being provided in the basic body which cooperate with edge surfaces of the two holding catches with the two edge surfaces pointing in the perpendicular direction, and the guiding surfaces limiting the penetrating opening of the basic body at both sides in the perpendicular direction in the area the penetrating opening opens into the belt opening, wherein a wall, located between a lateral surface of the receiving part and the penetrating opening through the basic body, comprises first and second recesses, beginning at the belt opening in an area adjacent to lateral edges of a window, which is formed by the penetrating opening extending through the basic body into the belt opening.

2. A belt buckle according to claim 1, wherein the guiding surfaces are located in planes with normal surfaces thereof being essentially aligned parallel in reference to the perpendicular direction.

3. A belt buckle according to claim 1, further comprising a step on the insertion appendage having edge surfaces pointing in the perpendicular direction and cooperating with edge surfaces of guiding recesses of the basic body beginning at the inserting side of the basic body of the insertion part.

4. A belt buckle according to claim 3, wherein the edge surfaces of the insertion appendage and the edge surfaces of the guiding recesses cooperating therewith comprise normal surfaces essentially positioned parallel in reference to the perpendicular direction.

5. A belt buckle according to claim 1, wherein the insertion appendage of the insertion part protrudes from the entrance of the penetrating opening into the belt opening, in the state inserted in the receiving part, and projects into the belt opening.

6. A belt buckle according to claim 1, wherein the latches in their locking positions are acted upon by spring elements.

7. A belt buckle comprising:

a. an insertion part having at least one belt opening for guiding a belt and an insertion appendage extending in a direction of insertion with holding catches protruding at both sides in a perpendicular direction, b. a receiving part with at least a belt opening for guiding a belt and with an insertion opening, beginning at an inserting side of the basic body for inserting the insertion appendage of the insertion part in the direction of insertion, c. latches pivotally mounted to the basic body, which in a locking position in an inserted state of the receiving part and the insertion part cooperate with the holding catches of the insertion appendage of the insertion part and retain the insertion appendage in the insertion opening of the receiving part, d. the insertion opening beginning at the inserting side of the basic body and forming a penetrating opening penetrating the basic body to the belt opening, and e. guiding surfaces being provided in the basic body which cooperate with edge surfaces of the two holding catches with the two edge surfaces pointing in the perpendicular direction and the guiding surfaces limiting the penetrating opening of the basic body at both sides in the perpendicular direction in the area the penetrating opening opens into the belt opening, wherein the insertion appendage of the insertion part protrudes from the entrance of the penetrating opening into the belt opening, in the state inserted in the receiving part, and projects into the belt opening.

8. A belt buckle comprising:

a. an insertion part having at least one belt opening for guiding a belt and an insertion appendage extending in a direction of insertion with holding catches protruding at both sides in a perpendicular direction, b. a receiving part with at least a belt opening for guiding a belt and with an insertion opening, beginning at an inserting side of the basic body for inserting the insertion appendage of the insertion part in the direction of insertion, c. latches pivotally mounted to the basic body, which in a locking position in an inserted state of the receiving part and the insertion part cooperate with the holding catches of the insertion appendage of the insertion part and retain the insertion appendage in the insertion opening of the receiving part, d. the insertion opening beginning at the inserting side of the basic body and forming a penetrating opening penetrating the basic body to the belt opening, and e. guiding surfaces being provided in the basic body which cooperate with edge surfaces of the two holding catches with the two edge surfaces pointing in the perpendicular direction and the guiding surfaces limiting the penetrating opening of the basic body at both sides in the perpendicular direction in the area the penetrating opening opens into the belt opening, wherein a step on the insertion appendage projects from a base of the insertion appendage in a projection direction, which is perpendicular to the direction of insertion and perpendicular to the perpendicular direction, and has edge surfaces which are aligned parallel to the direction of insertion and point in the perpendicular direction, and wherein the edge surfaces of the step cooperate with edge surfaces of a guiding recess which is provided in a wall delimiting the penetrating opening in the projection direction on a first side, wherein the guiding recess begins at the inserting side of the basic body of the insertion part.

* * * * *